United States Patent [19]

Ferguson, Jr. et al.

[11] Patent Number: 4,571,311

[45] Date of Patent: Feb. 18, 1986

[54] APPARATUS FOR INTRODUCING A PROCESS GAS INTO A TREATMENT CHAMBER

[75] Inventors: William B. Ferguson, Jr., Harpersville; Gerald E. Bresowar, Homewood; Louis B. Wheeler, Birmingham, all of Ala.

[73] Assignee: Combustion Engineering, Inc., Windsor, Conn.

[21] Appl. No.: 693,406

[22] Filed: Jan. 22, 1985

[51] Int. Cl.[4] ..... B01F 3/04

[52] U.S. Cl. ..... 261/64 B; 55/226; 55/236; 55/260; 159/4 B; 159/4 S; 261/79 A; 261/89; 159/4.01; 159/4.3

[58] Field of Search ..... 261/64 B, 79 A, 88, 261/89; 55/226, 236, 260; 426/471; 159/4 B, 4 S; 99/473; 422/176

[56] References Cited

U.S. PATENT DOCUMENTS

| | | | |
|---|---|---|---|
| 1,961,956 | 6/1934 | Bleibtreu et al. | 261/79 A X |
| 2,670,036 | 2/1954 | Spalding | 159/4 S X |
| 3,225,523 | 12/1965 | Wiebe | 261/79 A X |
| 3,761,065 | 9/1973 | Rich et al. | 261/79 A X |
| 3,803,723 | 4/1974 | Lamm et al. | 159/4 S X |
| 4,226,603 | 10/1980 | Larsson et al. | 261/79 A X |
| 4,227,896 | 10/1980 | Larsson et al. | 261/79 A X |
| 4,260,563 | 4/1981 | Brulhet | 55/226 X |
| 4,320,092 | 3/1982 | Kondo et al. | 261/79 A X |
| 4,481,171 | 11/1984 | Baran et al. | 422/176 |

*Primary Examiner*—Richard L. Chiesa

*Attorney, Agent, or Firm*—William W. Habelt

[57] ABSTRACT

A process gas is introduced into a treatment chamber (40) through a horizontal spiral gas supply duct (30) having a tangential inlet (31) and opening to a pair of concentric, inner and outer annular gas inlet ducts (12,22) surrounding a liquid spray apparatus (2). Partition means (32) divide the spiral supply duct (30) into independent inner and outer sub-ducts (34,36) which define separate inner and outer flow passages (44,46) connected respectively to the inner and outer annular gas inlet ducts (12,22). Damper means (70) is provided in the inlet to the outer sub-duct (36) to selectively control the flow of process gas (7) therethrough as a means of maintaining the velocity of the flow of process gas (5) through the inner flow passage (44) above a minimum acceptable velocity.

4 Claims, 3 Drawing Figures

APPARATUS FOR INTRODUCING A PROCESS GAS INTO A TREATMENT CHAMBER

BACKGROUND OF THE INVENTION

The present invention relates generally to apparatus for introducing a process gas into a treatment chamber and, more particularly, to an apparatus for introducing a process gas into a liquid-gas contact zone surrounding a liquid spray apparatus disposed to spray a liquid into the treatment chamber.

There are many applications in the art wherein a process gas must be introduced into a treatment chamber to contact a liquid within the chamber. For example, in the drying of foodstuff, such as milk or slurries of food products, it is common to spray the liquid into a spray dryer where the liquid is contacted with hot air to dry the milk or foodstuff to produce a powder. Such spray dryers are also utilized for the absorption of pollutants from hot flue gases by spraying a slurry of particulate absorbent into a drying chamber and contacting the particulate slurry therein with hot flue gas whereby the particulate absorbent reacts with pollutants in the flue gas to remove the pollutants therefrom as a dry salt.

In such apparatus, the liquid, which may be a homogeneous solution or slurry of suspended particulate material, is atomized by means of a spray apparatus, such as a nozzle or an atomizer wheel, arranged centrally in a treatment chamber defined by a treatment vessel. The atomized spray is directed radially outward from the liquid spray apparatus into a liquid-gas contact zone in the form of an umbrella-like spray cloud. The process gas is introduced annularly about the liquid spray apparatus into the liquid-gas contact zone as uniformly as possible to contact the atomized liquid passing radially outward from the spray apparatus. Typically, the process gas is passed through a supply duct into one or more conical ducts disposed concentrically about the liquid spray apparatus and opening into the treatment chamber. As the process gas passes through the gas supply duct, a rotational motion may be imparted to the gas so that it enters the treatment chamber through the conical inlet ducts in a swirling fashion. The conical inlet ducts are designed to guide the process gas into the liquid-gas contact zone surrounding the liquid spray apparatus. Examples of this type of gas distribution device may be found in U.S. Pat. Nos. 3,803,723, 4,226,603, 4,227,896, and 4,481,171.

In some applications, particularly when utilized as flue gas scrubbing devices, spray dryers must operate over a wide range of gas flow volumes. Thus, it is desirable to provide a gas flow distribution apparatus which is capable of supplying process gas to the liquid-gas contact zone over a wide range of gas flow volume at a relatively constant velocity to insure proper mixing of the atomized particulate absorbent slurry with the process gas in the liquid-gas contact zone. Accordingly, it is an object of the present invention to provide an apparatus for introducing a process gas into a treatment chamber wherein a velocity can be maintained above a minimum acceptable level in the region surrounding the liquid spray apparatus so as to insure proper mixing of the atomized liquid with the process gas being introduced into the treatment chamber over a wide range of turndown.

SUMMARY OF THE INVENTION

The process gas introduction apparatus of the present invention comprises a horizontal spiral gas supply duct disposed about an inner shell adapted to receive and support a liquid spray apparatus and having a tangential inlet opening for receiving the process gas and an outlet opening mating with a first and a second gas inlet duct extending therefrom. The first gas inlet duct is disposed centrally about the liquid spray apparatus and defines an inner annular conduit having an annular outlet opening into the treatment chamber about the liquid spray apparatus. The second gas inlet duct is disposed concentrically about and spaced radially from the first gas inlet duct and defines an outer annular conduit having an annular outlet opening into the treatment chamber about the first gas inlet duct.

In accordance with the present invention, partition means are disposed within the horizontal spiral gas supply duct so as to divide the spiral gas supply duct into a first and a second horizontal gas supply sub-duct. The first gas supply sub-duct mates with and opens into the first gas inlet duct to form therewith an inner passageway for directing a first portion of the process gas into the treatment chamber into the liquid gas zone immediately surrounding the liquid spray apparatus. The second gas supply sub-duct mates with and opens into the second gas inlet duct to form therewith an outer passageway for directing a second portion of the process gas into the treatment chamber in an annular stream surrounding the first portion of the process gas introduced into the treatment chamber. Additionally, damper means are disposed in the second gas supply sub-duct near the inlet thereto for controlling the flow of the process gas through the second gas supply sub-duct. The damper means is selectively positionable across the second gas supply sub-duct so as to regulate the cross-sectional flow area at the inlet of the gas supply duct for controlling the pressure differential between the inlet to the horizontal spiral gas supply duct and the outlet of the inner and outer gas inlet duct to the treatment chamber.

Further in accordance with the present invention, a plurality of generally vertical vanes are mounted to abut the inner shell at circumferentially spaced intervals so as to extend radially into the inner annular conduit. The vanes extend generally vertically along the outer wall of the inner shell to terminate at the plane of the annular outlet opening of the inner annular conduit and extend radially outwardly from the inner shell toward the first gas inlet duct for a limited distance, preferably about one-half of the radial distance therebetween. These vanes are provided to eliminate or at least substantially reduce the swirling motion of the process gas passing from the inner annular conduit, thereby greatly reducing or eliminating the lifting of the spray cloud associated with highly swirling gas streams.

DESCRIPTION OF A PREFERRED EMBODIMENT

Figure 1:
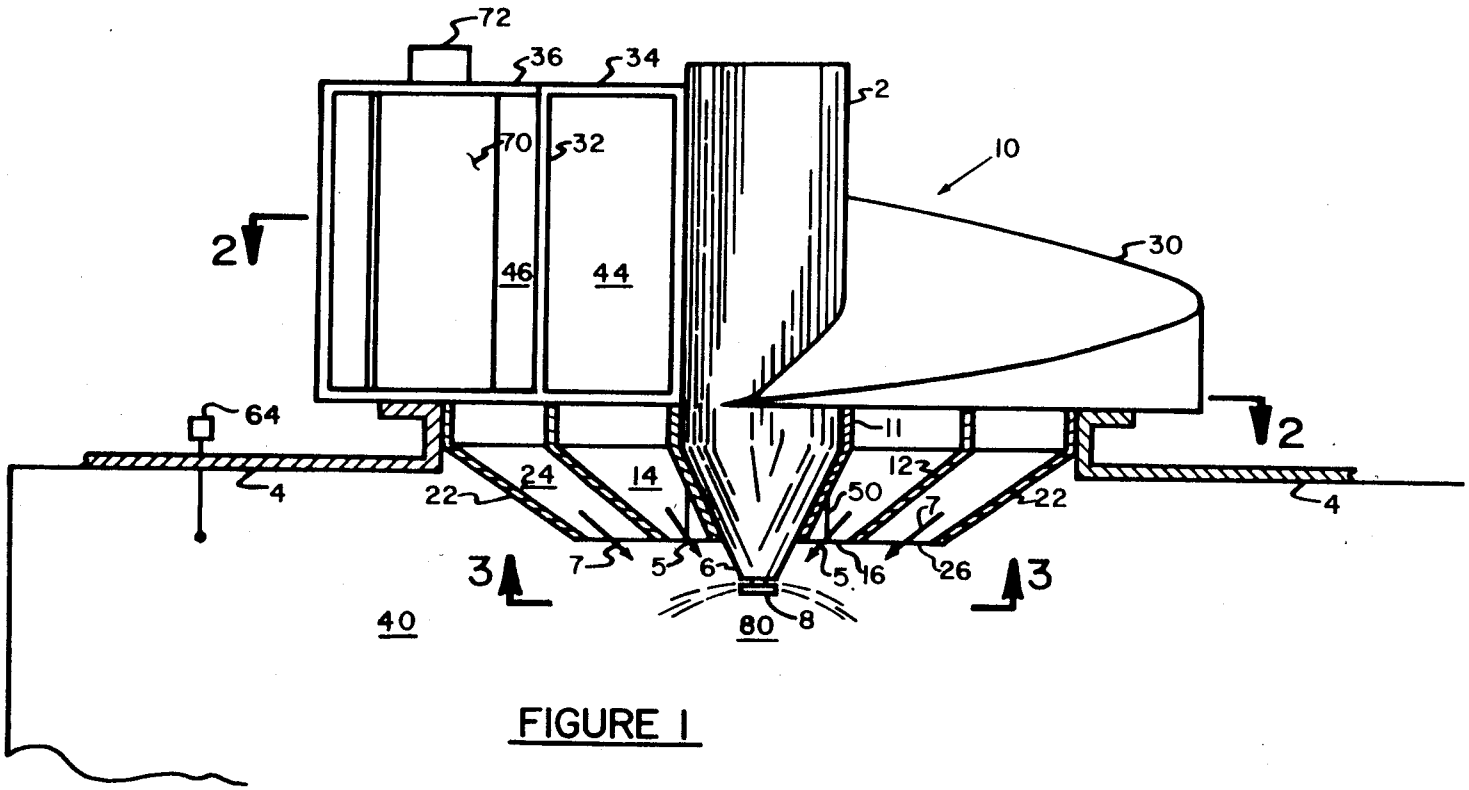
FIG. 1 is an elevational view, partly in section, of the gas distribution apparatus of the present invention.
Figure 2:
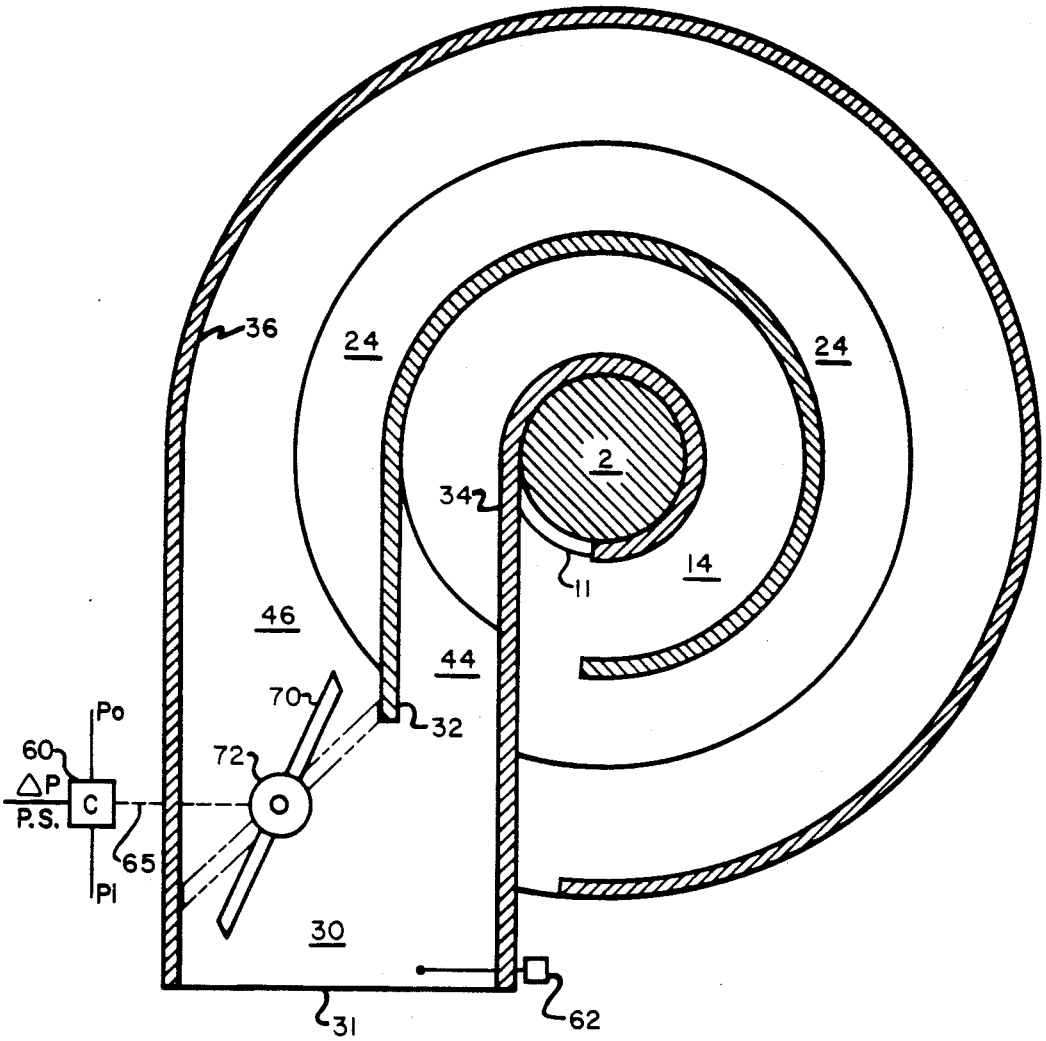
FIG. 2 is a sectional plan view taken along line 2—2 of FIG. 1.
Figure 3:
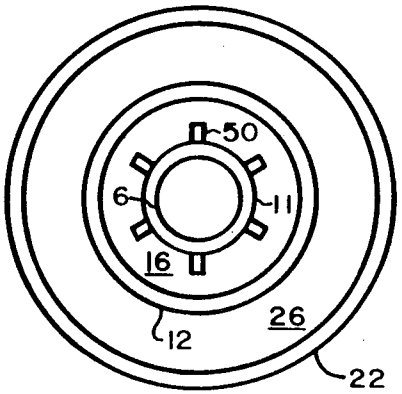
FIG. 3 is a sectional plane view taken along line 3—3 of FIG. 1.

Referring now to the drawing, there is depicted therein an apparatus 10 designed in accordance with the present invention for introducing a process gas into a treatment chamber. The apparatus 10 is mounted to the roof of the treatment vessel 4 in mating relationship with and is disposed concentrically about a liquid spray apparatus 2 so as to support the liquid spray apparatus 2 centrally in an opening in the roof of the treatment vessel 4 to extend into the treatment chamber 40 for introducing an atomized liquid spray into the liquid-gas contact zone 80 of the treatment chamber 40. The liquid spray apparatus 2 may incorporate any of a number of well known atomizing spray means, such as a mechanical atomizing spray nozzle, a sonic spray nozzle, or, as shown in the drawing, a rotating wheel-type atomizer.

The liquid spray apparatus 2 is supported centrally in the opening in the roof of the treatment vessel 4 by insertion in the inner shell portion 11 of the apparatus 10 disposed centrally along the longitudinal axis of the apparatus 10. The inner shell 11 defines therein an open-ended chamber contoured to receive the liquid spray apparatus 2 in mating relationship therewith so as to prevent the liquid spray apparatus 2 from falling into the treatment chamber 40. As a typical liquid spray apparatus has a cylindrical body with a conical tip portion extending therefrom, the inner shell 11 preferably comprises an upper cylindrical flange sized to receive the body of the liquid spray apparatus and a lower conical shell adapted to receive the conical tip of the liquid spray apparatus such that the spray means 8 thereof extends into the treatment chamber 40 through the open lower end of the conical shell portion of the inner shell 11.

Typically, it is desirable to introduce the process gas into the liquid-gas contact zone located in the treatment chamber 40 about the tip 6 of liquid spray apparatus 2 into separate coannular streams concentrically about the liquid spray apparatus 2. To this end, the apparatus 10 of the present invention has two gas inlet ducts extending through the opening in the wall of the treatment vessel 4 into the treatment chamber 40 defined therein. The first gas inlet duct 12 is disposed centrally about the inner shell 11 which houses the liquid spray apparatus 2 and defines an inner annular conduit 14 having an annular outlet 16 opening into the treatment chamber 40 about the tip 6 of the liquid spray apparatus 2. A second gas inlet duct 22 is disposed concentrically about and spaced radially outward from the first gas inlet duct 12 and defines an outer annular conduit 24 having an annular outlet 26 opening into the treatment chamber 40 about the first gas inlet duct 12. Preferably, both the first and second gas inlet ducts are comprised of an upper cylindrical flange adapted to mate with the horizontal spiral gas supply duct 30 disposed thereabove and a lower conical skirt portion adapted to direct the process gas passing through their respective conduits into the liquid gas contact zone 80 formed in the treatment chamber 40 about the tip 6 of the liquid spray apparatus 2.

The gas introduction apparatus 10 of the present invention also includes a horizontal gas supply duct 30 disposed about the upper end of the liquid spray apparatus 2 and having an inlet opening 32 for receiving the process gas and an outlet opening mating with the first and second gas inlet ducts 12 and 22. The horizontal gas supply duct 30 not only directs the process gas to the inlet duct 12 and 22 for introduction into the treatment chamber 40 but also causes a rotational component of flow to be imparted to the process gas as it passes through the spiral flow passages defined by the horizontal gas supply duct 30 before entering the inlet ducts 12 and 22.

In accordance with the present invention, partition means 32 is disposed within the horizontal gas supply duct 30 to divide the horizontal gas supply duct into a first horizontal gas supply sub-duct 34 and a second horizontal gas supply sub-duct 33 disposed in side-by-side relationship, and damper means 38 is disposed in the second gas supply sub-duct 36 at the inlet thereto for controlling the flow of process gas through the second gas supply sub-duct 36. The first gas supply sub-duct 34 mates with and opens to the first gas inlet duct 12 to form therewith an innerflow passageway 44 for directing a first portion 5 of the process gas into the treatment chamber 40. The second gas supply sub-duct 36 mates with and opens to the second gas inlet duct 24 to form therewith an outer flow passageway 46 for directing a second portion 7 of process gas into the treatment chamber 40. The damper means is selectively positionable across the second gas supply sub-duct 36 so as to regulate the cross-sectional flow area at the inlet of the outer flow passageway 46 through the treatment chamber 40 through the second gas supply sub-duct 36 and the second gas inlet duct 24.

Further in accordance with the present invention, a plurality of generally vertical vanes 50 are mounted to and about the lower portion of the outer wall of the inner shell 11 at circumferentially spaced intervals so as to extend radially outward into the inner conduits 14. The lower edges of the vanes 50 terminates at the plane of the outlet 16 of the inner conduit 14. The vanes 50 extend radially across the annular outlet 16 of the inner conduit 14 for a limited distance. That is, the vanes 50 do not extend all the way across the outlet 16 to contact the first gas inlet duct 12. Preferably, the vanes 50 extend outwardly about 50% of the distance across the annular outlet 16 of the inner conduit 14.

The vanes 50 which extend into the inner conduit 14 at and near the outlet 16 thereof are necessary to preclude the establishment of a strong low pressure zone in the vicinity of the atomized spray. Due to the tangential inlet feature and spiral nature of the inner and outer conduits 14 and 24, the apparatus 10 of the present invention imparts a great deal of swirling motion to the process gas stream passing therewith. Left unchecked, a strong swirling motion in the inner gas stream results in the establishment of a strong low pressure zone in the region surrounding the spray top of the liquid spray apparatus 2 as the gas stream swirls thereabout. Such a low pressure zone in turn induces an upward velocity gradient which tends to lift the spray. Under certain conditions, the spray may be lifted backupon the atomizer body or even up into the inner conduit, resulting in the highly undesirable deposition of material on those surfaces.

The generally vertical nature of the vanes 50 causes the gas stream leaving the inner conduit 14 to be directed downwardly which destroys most of the swirling motion of the gas stream leaving the inner conduit 14. The vanes 50 may be up to about 15° off vertical and still function to lessen the swirling motion of the gas stream to the extent that significant lifting of the liquid spray cloud does not occur.

In operation, the process gas to be supplied to the treatment chamber 4 is passed to the horizontal spiral gas supply duct 30 through the inlet 31 therethrough. As the process gas passes through the inlet 31 to the horizontal gas supply duct 30, the process gas encounters the leading edge of the partition means 32 and a first portion 5 of the process gas passes to the inner side of the partition 32 to flow through the inner flow passageway 44 while a second portion 7 of the process gas passes to the outer side of the partition means 32 to flow through the outer flow passageway 46 to the treatment vessel 40. The partition means 32 is disposed within the horizontal gas supply duct 30 so as to divide the horizontal gas supply duct 30 into appropriately sized first and second gas supply sub-ducts 34 and 36 with the damper means positioned in alignment with the flow entering the gas supply duct 30 for full load operation. In this manner, the first and second gas supply sub-duct 34 and 36 are sized to provide the proper flow volume and desired velocity through the inner flow passageway 44 and outer flow passageway 46 at the designed rate of volume flow to the treatment vessel 40.

However, it is often necessary to operate the system over a wide range of volume flow rates extending significantly below the design volume flow rate for the flow introduction apparatus 10. A turndown ratio of 4 to 1 or better is desirable. In accordance with the present invention, the volume flow rate through the inner flow passageway 44 to the treatment vessel 40 can be maintained above a minimum level so as to maintain an acceptable velocity through the inner flow passageway 44 over a wide range of volume flow rate below the design volume flow rate for the apparatus 10 by selectively positioning the damper means across the inlet to the second flow passageway 46 so as to decrease the cross-sectional flow area at the inlet thereto. By closing the damper means, the pressure drop between the inlet to the spiral gas supply duct 30 and the outlet of the first and second gas inlet ducts 12 and 22 to the treatment vessel 40 may be controlled so as to be maintained at a preselected setpoint level corresponding to that pressure drop which provides the proper design volume flow rate and velocity through the inner flow passageway 44 necessary to provide optimum liquid and gas mixing in the liquid-gas contact zone 80.

In the preferred mode of operation, controller means 60 operatively associated with the damper means 70 is provided for comparing the sensed gas pressure differential, $P_I - P_O$, between the inlet to the horizontal spiral gas supply duct 30 and the outlet opening of the first gas inlet duct 12 to a preselected setpoint pressure differential, $\Delta P_{s.p.}$ which corresponds to a velocity at or above the acceptable minimum velocity. The exact setpoint differential and corresponding minimum acceptable velocity will be selected on a case-by-case basis to optimize the gas liquid contact process for each application. A pressure sensing device 62 is disposed in the inlet of the horizontal gas supply duct 30 to sense the inlet pressure, $P_I$, and send a signal indicative thereof to controller means 60 while a second pressure sensing device 64 is disposed in the upper section of the treatment vessel 40 to sense the gas pressure at the outlet of the first gas inlet duct 12 and send a signal indicative thereof to the controller 60. Upon receiving these pressure indicative signals, the controller 60 calculates the sensed pressure differential, $P_I - P_O$, and compares that sensed pressure differential to the setpoint differential. If the sensed pressure differential has departed from the setpoint pressure differential, the controller 60 sends a signal 65 to damper drive means 72 operatively associated with the damper means 70. In response to the control signal 65, the damper drive means 72 is operated to selectively position the damper means across the second horizontal spiral gas supply sub-duct 36 to appropriately close the second gas supply sub-duct 36, i.e. decrease the cross-sectional flow area at the inlet thereof, so as to appropriately increase the pressure drop between the inlet to the horizontal spiral gas supply duct 30 and the outlet of the first inlet duct to the treatment vessel 40 so as to maintain the sensed gas pressure differential equal to the preselected setpoint differential, whereby the velocity of the first portion of the process gas passing through the inner passageway is maintained above the acceptable minimum velocity.

As the damper means 70 is manipulated to further close-off the inlet to the second horizontal spiral gas supply sub-duct 36, the cross-sectional area at the inlet of the sub-duct 36 is decreased which in turn causes the flow volume of the second portion 7 of the process gas passing through the outer flow passage to decrease and the volume flow rate of the first portion 5 of the process gas passing through the inner flow passageway 44 to increase. In this manner, the damper 70 can be selectively positioned so as to maintain the volume flow through the inner flow passageway 44 at a desired level, thereby maintaining the velocity through the inner flow passageway above the acceptable minimum level.

By maintaining the velocity through the inner flow passageway 44 above the acceptable minimum level, it is insured that the mixing of the radially outwardly directed spray of liquid from the nozzle tip 6 will be optimumly contacted and mixed with the first portion 5 of the process gas in the liquid-gas contact zone 80 even though the total volume flow rate of process gas has decreased. Therefore, the present invention provides an apparatus for introducng a process gas into the liquid-gas contact zone 80 surrounding the tip 6 of the liquid spray apparatus 2 in such a manner that a sufficient volume of process gas at a sufficient high velocity will be contacted with the atomized spray leaving the tip 6 in the liquid-gas contact zone 80 at optimum conditions over a wide range of total volume flow rates to the apparatus 10 even though the total volume flow rate may be well below the design flow rate for the apparatus.

We claim:

1. In combination with a treatment chamber having a liquid-gas contact zone surrounding a liquid spray apparatus disposed to spray a treatment liquid into said treatment chamber, an apparatus for introducing a process gas into said liquid-gas contact zone comprising:

a. an open-ended inner shell supporting the liquid spray apparatus in a position with the spray means of the liquid spray apparatus extending through an open end of said said inner shell into the treatment chamber;

b. a first gas inlet duct disposed centrally about said inner shell supporting the liquid spray apparatus and defining an inner annular conduit having an annular outlet opening into the treatment chamber about the liquid spray apparatus;

c. a second gas inlet duct disposed concentrically about and spaced radially from said first gas inlet duct and defining an outer annular conduit having an annular outlet opening into the treatment chamber about said first gas inlet duct;

d. a horizontal spiral gas supply duct disposed about said liquid spray apparatus and having an inlet opening for receiving the process gas and an outlet opening mating with said first and second gas inlet ducts;

e. partition means disposed vertically within said horizontal spiral gas supply duct and extending across said horizontal spiral gas supply duct so as to divide said horizontal spiral gas supply duct into a first and a second horizontal spiral gas supply sub-duct disposed in side-by-side relationship, the first gas supply sub-duct mating with and opening to said first gas inlet duct to form therewith an inner flow passageway for directing a first portion of process gas into the treatment chamber, and the second gas supply sub-duct mating with and opening to said second gas inlet duct to form therewith an outer flow passageway for directing a second portion of process gas into the treatment chamber;

f. damper means disposed in the second gas supply sub-duct at the inlet thereto for controlling the flow of process gas through the second gas supply sub-duct, said damper means being selectively positionable across the second gas supply sub-duct so as to regulate the cross-sectional flow area at the inlet of the outer flow passageway defined by the second gas supply sub-duct and the second gas inlet duct; and g. a plurality of vane means mounted to said inner shell at spaced intervals about the circumference thereof, each of said vane means disposed generally vertically and extending outwardly from said inner shell into the inner annular conduit.

2. An apparatus as recited in claim 1 further comprising:

a. controller means operatively associated with said damper means for comparing the gas pressure differential between the inlet to said horizontal spiral gas supply duct and the upper portion of the treatment vessel to a preselected setpoint pressure differential; and b. damper drive means operatively associated with said damper means for selectively positioning said damper means across the second horizontal spiral gas supply sub-duct in response to the pressure differential comparison means so as to maintain the sensed gas pressure differential equal to the preselected setpoint pressure differential, whereby the velocity of the first portion of process gas passing through the inner passageway is maintained at a constant velocity.

3. An apparatus as recited in claim 1 wherein said vane means each extend generally vertically along said inner shell to terminate at the plane of the annular outlet opening of said inner annular conduit.

4. An apparatus as recited in claim 3 wherein said vane means each extend radially outwardly from said inner shell toward said first gas inlet duct to terminate at a distance about one-half of the radial distance across said inner annular conduit in the plane of the annular outlet opening of said inner annular conduit.

* * * * *